United States Patent [19]

Farag et al.

[11] Patent Number: 4,513,180

[45] Date of Patent: Apr. 23, 1985

[54] CIRCUIT BREAKER OPERATOR AND INTERLOCK

[75] Inventors: Samir F. Farag; Edgar W. Allen; Thomas R. Little, all of Wichita Falls, Tex.

[73] Assignee: Siemens-Allis, Inc., Atlanta, Ga.

[21] Appl. No.: 573,384

[22] Filed: Jan. 24, 1984

[51] Int. Cl.[3] ..... H01H 9/20

[52] U.S. Cl. ..... 200/50 R; 200/50 AA

[58] Field of Search ..... 200/50 R, 50 AA; 361/339, 343, 391

[56] References Cited

U.S. PATENT DOCUMENTS

| | | | |
|---|---|---|---|
| 2,344,636 | 3/1944 | Quast | 200/50 |
| 3,122,615 | 2/1964 | Chace | 200/50 |
| 3,311,720 | 3/1967 | Johnson | 200/50 |
| 3,358,094 | 12/1967 | Metz | 200/50 |
| 3,896,353 | 7/1975 | Burton et al. | 200/50 AA X |
| 4,104,491 | 8/1978 | Doble | 200/50 |
| 4,206,329 | 6/1980 | Jarosz | 200/50 AA |
| 4,317,160 | 2/1982 | Tillson et al. | 200/50 AA X |
| 4,412,112 | 10/1983 | Ishikawa et al. | 200/50 AA |

*Primary Examiner*—A. D. Pellinen
*Assistant Examiner*—Susan A. Steward
*Attorney, Agent, or Firm*—F. W. Powers; J. L. James

[57] ABSTRACT

An operator is provided for a molded-case circuit breaker of the type in a motor controller where the circuit breaker is removably mounted on a pan brace which is held in place by a pan latch. The operator mounts on the breaker for opening and closing the breaker and for providing three interlocks. One interlock prevents withdrawal or insertion of the breaker with the operator handle in the "on" position. A second interlock prohibits closing or opening the control door except when the handle is off and a third interlock locks the operator handle in "off" position.

20 Claims, 10 Drawing Figures

CIRCUIT BREAKER OPERATOR AND INTERLOCK

TECHNICAL FIELD

This invention relates generally to operators for circuit breakers and more particularly to a mechanical operator for a molded case circuit breaker enclosed in an equipment structure behind a circuit breaker access door which hinders inadvertent mechanical operation of the circuit breaker and unintentional removal of the circuit breaker from the equipment structure.

BACKGROUND ART

It has been common practice to provide enclosures for electrical control equipment which were typically constructed of heavy steel frame members and covered with heavy sheet metal panels which were bolted, or more likely welded, to the frame members. This resulted in heavy, expensive structures which are now being supplanted by lightweight, more economical structures. A modular approach is being taken to facilitate the use of replaceable plug-in units. For a motor control unit there now exists a lightweight framework into which a removable pan assembly is placed which includes a molded case circuit breaker. The pan assembly and circuit breaker are held in place by a pan latch which releasably holds the assembly in place. This allows the pan assembly and circuit breaker to be easily removed in the field to facilitate inspection, repair and modification.

It is common practice to provide enclosures for electrical control equipment with interlock features to permit accessibility to the interior of the enclosure by a skilled worker when desired, but to prevent inadvertent entry into the enclosure when the enclosed circuit breaker and control elements are electrically energized. An interlock is typically designed to fit one enclosure or device made by one manufacturer so that an interlock is an element which must be included when designing equipment such as a motor control center.

Typical circuit breaker operators and interlock arrangements are disclosed in U.S. Pat. No. 3,122,615 which issued on Feb. 25, 1964 to R. L. Chace and U.S. Pat. No. 4,104,491 which issued on Aug. 1, 1978 to G. R. Duble. These patents generally disclose mechanisms which are designed to fulfill the requirement that the interlock between the switching device and the door of its enclosure normally prevent operation of the switch to close its contacts when the door is open, that it be possible to defeat the interlock deliberately to close the switch contacts when the door is open, that it prevent closing of the switching device while the door is being closed until the door has been properly secured with fastening hardware, that the interlock not interfere with the proper closing of the door when the switching device is on, and that the mechanical linkage between the switching device and its operating handle be such that the handle remains in control of the device, even when the door of the enclosure is open.

These mechanisms were designed for use with prior enclosures and framework and were not designed with lightweight framework and molded-case circuit breakers in mind. These devices have many parts, some of which may require plating or machining, and are not necessarily simple in construction or operation. They are relatively complicated to use, if at all, with molded-case circuit breakers. It is therefore desirable to have a mechanism which is simple to operate and relatively inexpensive to manufacture which is useable with modern framework and molded case breakers.

Mechanisms useable with molded case breakers are disclosed in U.S. Pat. No. 3,311,720 which issued to J. E. Johnson on Mar. 28, 1967 and U.S. Pat. No. 3,358,094 which issued to R. P. Metz on Dec. 12, 1967. These disclose a breaker handle operating mechanism which mounts as a unit on a circuit breaker or switch for operating the operating handle of the circuit breaker or switch, which mechanism comprises interlocking means cooperable with an enclosure cover structure to automatically latch the cover structure closed when the circuit breaker or switch is closed and to automatically latch the circuit breaker or switch open when the enclosure cover structure is opened.

It is clear that the above structures provide several interlocking features, but none interfere with removal of the pan assembly and circuit breaker in the modern environment or prevent their inadvertent or unintentional removal under full load. It is therefore desirable to have a circuit breaker operator and interlock which prevents unintentional or inadvertent removal of the circuit breaker and prohibits removal of the breaker under load. It is also desirable to have a universal circuit breaker operator which is useable with various manufacturers' circuit breakers without major modification to the circuit breaker or the operator.

Accordingly, it is an object of the present invention to provide a universal circuit breaker operator and interlock which is simple to operate and economical to manufacture and adapts to fit most breakers. This object is achieved by using a slidably moveable assembly which does not require special machining and which has an opening for receiving the handle of a circuit breaker.

It is an object of the present invention to provide a circuit breaker operator and interlock which prohibits removal of the circuit breaker under load. This objects is achieved by providing a sliding operator mechanism which locks the pan assembly in place and prevents unintentional removal of the circuit breaker under load and prevents insertion of the breaker under load.

DISCLOSURE OF INVENTION

In one aspect of the invention, a circuit breaker operator is provided for a circuit breaker assembly of the type having a pan assembly removably mounted in an enclosure and having a slidable pan latch with an opening therein and a circuit breaker having a handle moveable between an on position and an off position mounted on the pan brace assembly. A frame has a middle portion with an opening, a top portion with an opening and angularly extending from the middle portion in a preselected direction. A bottom portion angularly extends from the middle portion in a preselected direction. An operator driver has an opening for receiving the circuit breaker handle and a protrusion and is movable between a first position and a second position. At the first position the opening is displaced toward the bottom portion of the frame and the protrusion extends through the opening in the top portion of the frame a first preselected distance above the top portion and the circuit breaker handle is at the off position. At the second position the opening is displaced from the bottom portion and the protrusion extends a second, greater preselected distance above the top portion and the circuit breaker handle is at the on position. The protrusion extends through the pan latch opening at the second position and prevents inadvertent removal of the circuit breaker.

In another aspect of the invention, a circuit breaker operator is provided for a circuit breaker assembly which has a removable circuit breaker with a handle moveable between a first position and a second position. A frame has a middle portion with an opening, a top portion with an opening and angularly extending from the middle portion in a preselected direction, a bottom portion with an opening and angularly extending from the middle portion in a preselected direction, and a right edge portion. Means are provided for mounting the frame on the circuit breaker. An operator driver has an opening, a first protrusion, and a second protrusion which extends through the bottom portion opening and is movable between a first position and a second position. At the first position the opening is displaced toward the bottom portion of the frame and the first protrusion extends through the opening in the top portion of the frame a first preselected distance above the top portion. At the second position the opening is displaced from the bottom portion and the protrusion extends a second, greater preselected distance above the top portion. The opening receives the circuit breaker handle in the mounted position and moves in concert therewith between the first and second positions. The first protrusion engages the circuit breaker assembly at the second position in the mounted position of the circuit breaker and hinders removal of the circuit breaker. An operator assembly has a base portion connected to the operator driver and a handle portion connected to the base portion and protruding through the opening of the middle portion of the frame. The operator handle is moveable in concert with the operator driver between a first position at which the operator handle is displaced toward the bottom portion and the operator driver is at the first position and a second position at which the handle is displaced toward the top portion and the operator driver is at the second position. A latch assembly has a latch member having a left edge portion, a protrusion, and an indentation engageable with the latch stop of the base portion of the operator assembly. Means are provided for urging the latch indentation into engagement with the latch stop. The handle and operator driver are fixed at the first position in response to the indentation being engaged with the latch stop. The protrusion is movable between a first position at which the protrusion is generally aligned with the right edge portion of the frame and the indentation is engaged with the latch stop and a second position at which the protrusion extends beyond the right edge portion and the indentation is free of engagement with the latch stop. The latch stop automatically moves into abutting contact with the left edge portion in response to movement of the protrusion from the first position to the second position thereby freeing the operator driver and handle for movement from the first position to the second position.

In another aspect of the invention, a circuit breaker operator includes a frame, an operator driver, an operator assembly and a latch assembly. The frame has a middle portion with an opening, a top portion with an opening and angularly extending from the middle portion in a preselected direction, and a bottom portion angularly extending from the middle portion in a preselected direction. The operator driver has an opening and a protrusion and is movable between a first position and a second position. At the first position the opening is displaced toward the bottom portion of the frame and the protrusion extends through the opening in the top portion of the frame a first preselected distance above the top portion. At the second position the opening is displaced from the bottom portion and the protrusion extends a second, greater preselected distance above the top portion. The operator assembly has a base portion with a latch stop and is connected to the operator driver. A handle portion is connected to the base portion and protrudes through the opening of the middle portion of the frame. The handle is moveable in concert with the operator driver between a first position at which the handle is displaced toward the bottom portion and the operator driver is at the first position and a second position at which the handle is displaced toward the top portion and the operator driver is at the second position. The latch assembly has a latch member with a left edge portion, a protrusion, and an indentation which is engageable with the latch stop and urged toward engagement therewith. The handle and operator driver are fixed at the first position in response to the indentation being engaged with the latch stop. The protrusion is movable between a first position at which the protrusion is generally aligned with the right edge portion of the frame and the indentation is engaged with the latch stop and a second position at which the protrusion extends beyond the right edge portion and the indentation is free of engagement with the latch stop. The latch stop automatically moves into abutting contact with the left edge portion in response to movement of the protrusion from the first position to the second position thereby freeing the operator driver and handle for movement from the first position to the second position.

The present invention provides a circuit breaker operator and interlock which prohibits removal of the circuit breaker under load. The circuit breaker operator and interlock is simple to operate and economical to manufacture and useable with any circuit breaker.

DETAILED DESCRIPTION

Figure 1:
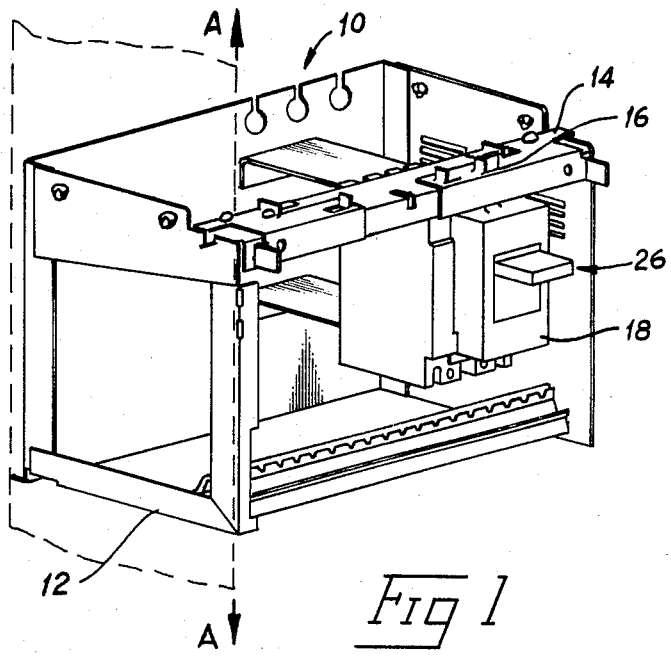
FIG. 1 is a diagrammatic view of an electrical equipment enclosure incorporating the present invention.
Figure 4:
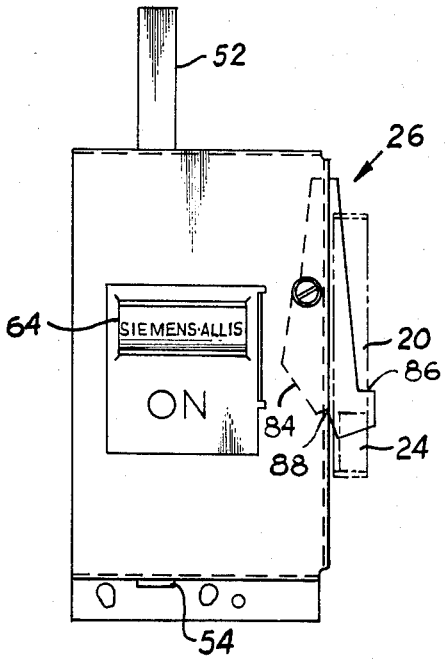
FIG. 4 is a front view of the invention showing the positions of various parts when the handle is in the "on" position.
Figure 5:
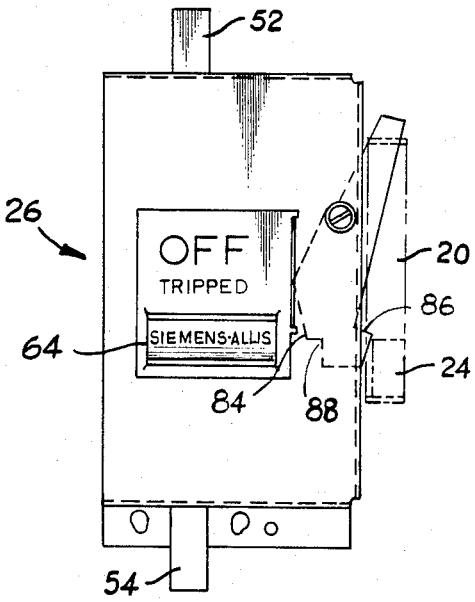
FIG. 5 is a front view similar to FIG. 4 but showing the various parts when the handle is in the "off" position.

Referring to FIG. 1, an apparatus, such as motor controller 10, for example, includes a pan assembly 12 which is removably mounted on the framework of the motor controller 10. The pan assembly 12 is of modular design which preferably plugs in to the bus work of the controller 10 for ease of installation, modification and repair. The pan assembly 12 is equipped with a slidable pan latch 14 with an opening 16 therein and a circuit breaker 18. The pan latch 14 is slidable to the left or right to lock or unlock the pan assembly 12 in position on the controller framework.

The circuit breaker 18 is preferably a molded case breaker which has a handle moveable from a first or "off" position to a second or "on" position. The circuit breaker 18 is mounted on the pan assembly 12 and may be hard wired or may be a plug-in.

Figures 2, 3:
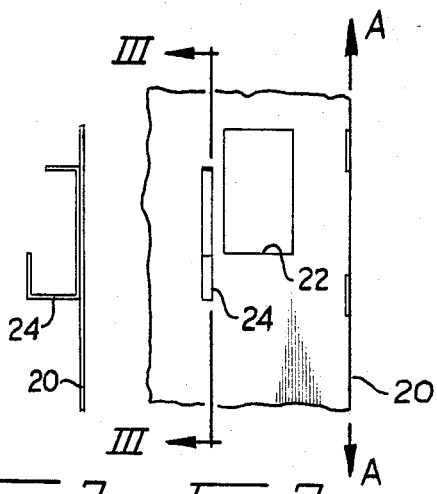
FIG. 2 is a diagrammatic view of an electrical equipment enclosure door which attaches to the equipment of FIG. 1 generally along line A—A.
FIG. 3 is a sectional view taken along line III—III of FIG. 2.

Referring to FIGS. 1–3, the motor controller 10 has a door 20 with a window 22 through which the circuit breaker handle is accessible when the door 20 is closed. The door 20 has a bracket 24, preferably "J" shaped, which cooperates with the invention for keeping the door 20 closed. The door 20 is hingedly connected to the motor controller framework along line A—A.

Referring to FIGS. 4–8, a circuit breaker operator 26 is shown in the "on" and "off" positions. The operator 26 includes a frame 28 which has a middle portion 30, top and bottom portions 32, 34, a mounting portion 36 and a right edge portion 37. The middle portion 30 has an opening 38, an opening 40 and a protrusion 41 extending from the middle portion 30. The top portion 32 has an opening 42 and the bottom portion 34 has an opening 44. The mounting portion 36 has a number of openings 46 and the edge portion 37 has an opening 47. The top portion 32 angularly extends from the middle portion 30 towards the circuit breaker 18 when installed. The bottom portion 34 likewise angularly extends from the middle portion 30 towards the breaker 18 when installed. Preferably, the top portion 32 and bottom portion 34 are substantially parallel so that the openings 42, 44 are alignable about a rigid body extending through them. The mounting portion 36 extends from the bottom portion 34 at an angle sufficient for mountably mating with the circuit breaker 18. The frame 28 is preferably of one-piece construction formed from a piece of sheet metal or the like and preferably mounted on the breaker 18 with threaded fasteners using the openings 46 in the mounting member 36. By this construction, the frame 28 mounts on the breaker 18 and provides an opening 38 through which to operate the breaker 18 to turn it "off" or "on".

Referring to FIGS. 4–8, an operator driver 48 has an opening 50 and a protrusion 52 and is moveable between a first position at which the opening 50 is displaced toward the bottom portion 34 and the protrusion extends through the opening 42 in the top portion 32 a first preselected distance above the top 30 and a second position at which the opening 50 is displaced from the bottom 34 and the protrusion 52 extends a second preselected distance above the top 32. The second preselected distance is greater than the first preselected distance. The operator driver 48 receives the circuit breaker handle in the opening 50 and moves the handle between the "off" and "on" positions as the driver 48 moves between the first and second positions, respectively. The protrusion 52 is extendable through the pan latch opening 16 at the second position and prevents inadvertent removal of the circuit breaker 18, both alone and as part of the pan assembly 12.

The operator driver 48 has a second protrusion 54 which extends through the bottom opening 44 during movement of the driver 48 between the first and second positions. By this construction, the opening 50 receives the circuit breaker handle in the mounted position and moves in concert therewith between the first and second positions. The first protrusion 52 engages the assembly 12 at the second position in the mounted position of the circuit breaker 18 and hinders removal of the circuit breaker 18 from the assembly 12. By adjusting the size and position of the opening 50 a universal operator is produced which fits all circuit breakers with protruding handles.

Figure 7:
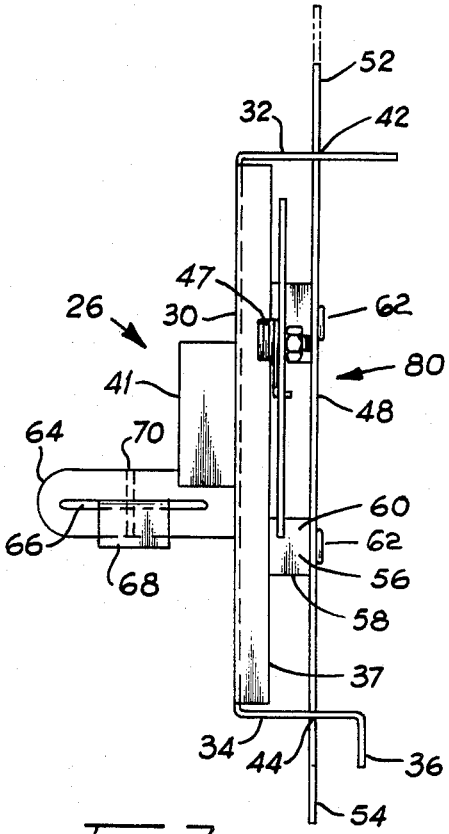
FIG. 7 is a simplified right side view of the 20 invention.
Figure 8:
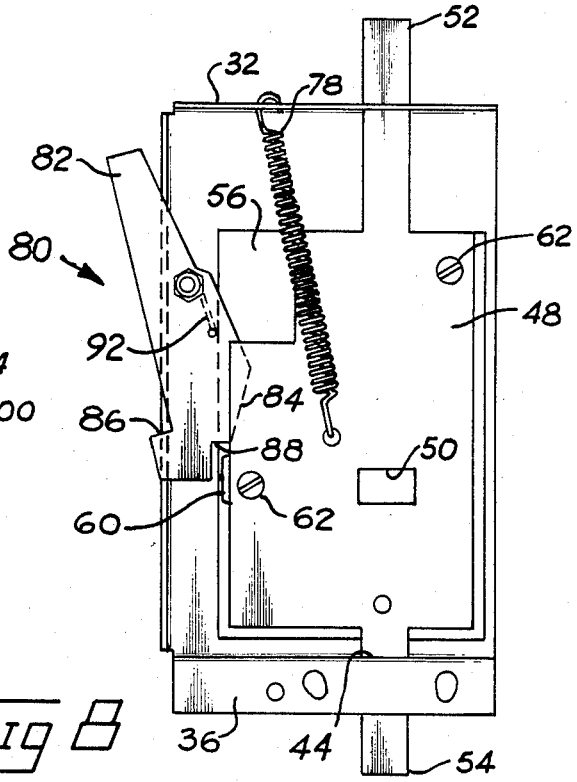
FIG. 8 is a simplified rear view of the invention.

An operator assembly 56 has a base portion 58 with a latch stop 60 formed thereon and is connected to the operator driver 48. As shown in FIG. 8, the operator driver 48 is preferably connected to the base 58 by fasteners such as screws 62. As best seen in FIG. 7, the screws 62 engage protrusions extending from the base 58. One of the protrusions has a flat contour which forms the latch stop 60. The base 58 is preferably formed of an electrically insulative, strong, durable material, such as resinous or polymeric material, for example.

The operator assembly 56 has a handle 64 which is connected to the base 58 and preferably integrally formed therewith. The handle 64 protrudes through the opening 38 of the middle 30 of the frame 28. The base 58 is larger than the opening 38 so that when handle 64 is inserted through opening 38 from the rear of the middle portion 30, the base 58 does not pass through the opening 38 but rests against the rear surface of the middle portion 30. A felt pad or other similar material can be inserted between the base 58 and the rear of the middle portion 30 to facilitate relative sliding motion between the base 58 and middle 30. The handle 64 is movable in concert with the operator driver 48 between a first position and a second position. At the first position the handle 64 is displaced toward the bottom 34 and the operator driver 48 is at the first or "off" position. At the second position the handle 64 is displaced toward the top 32 and the operator driver 48 is at the second or "on" position. As is known in the art, "OFF TRIPPED" is visible on the handle 64 in the opening 38 when the circuit breaker 18 is open and "ON" when the breaker 18 is closed.

Figure 6:
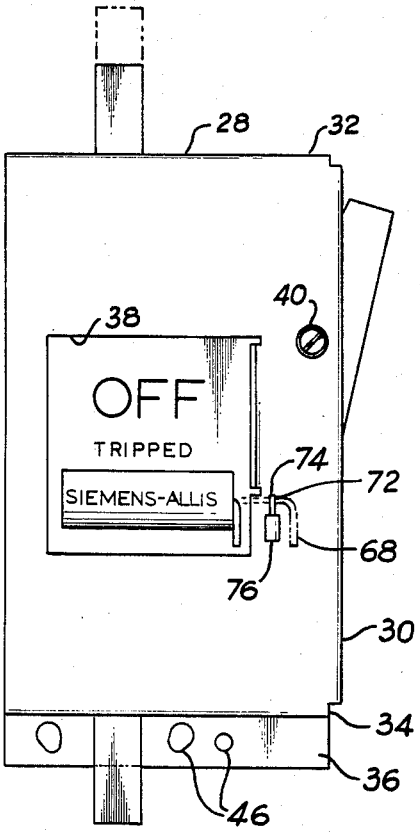
FIG. 6 is a front view similar to FIG. 5 but showing the handle secured with a padlock.

Referring to FIGS. 6–7, the handle 64 has slot or recess 66 into which is positioned a padlock receiving member 68 which is slidably moveable and retained by a retaining pin 70. The padlock member 68 has a slot or opening 72 of a size sufficient for receiving a shackle 74 of a padlock 76. The padlock member 68 is slidably movable between a first position and a second position. At the first position the slot 72 is concealed in the handle 64 and the padlock receivng member 68 is free of interference with the middle portion protrusion 41 during movement of the handle 64 between the "off" and "on" positions. The padlock 76 is not insertable at the concealed position of the receiving member 68. At the second position the slot 72 is revealed and the receiving member 68 interferes with movement of the handle 64 from the "off" position. The padlock 76 can be inserted to lock the handle 64 in the "off" position as shown. By lowering the height of the protrusion 41 the handle 64 may also be locked in the "on" position. By this construction the handle 64 can be locked in either the "off"

or "on" position so that the handle 64 cannot be moved from either position without first removing the padlock 76.

Referring to FIG. 8, means, such as a coil spring 78, are provided for biasing or urging the operator driver 48 and handle 64 toward the second position. More specifically, the spring 78 urges the latch stop 60 toward a preselected position. The spring 78 preferably has one end connected to the operator driver 48 and the other end preferably connected to the top 32 of the frame 28. The spring 78 may be attached in any suitable manner. It is simple to punch holes in the respective pieces to receive the ends of the spring 78.

Figure 10:
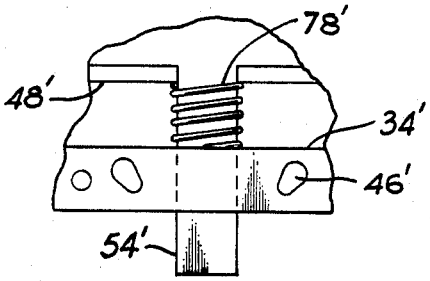
FIG. 10 is a partial rear view similar to FIG. 8 but showing another embodiment.

As an alternative, a spring 78' may be coiled about the second protrusion 54' of the operator driver 48' abutting the operator driver 48' and bottom portion 34' of the frame 28' (FIG. 10).

Referring to FIG. 8, a latch assembly 80 includes a latch member 82 which has a left edge portion 84, a protrusion 86, an indentation 88, and an opening 90. Means such as spring 92, are provided for urging the indentation 88 into engagement with the latch stop 60. The indentation 88 is engageable with the latch stop 60 to latch the operator driver 48 in the first position. As the operator driver 48 moves from the second position to the first position, the latch stop 60 rides along the left edge 84. When the latch stop 60 falls below the indentation 88 the spring 78 urges the latch stop 60 upward toward engagement with the indentation 88. The handle 64 and operator driver 48 are fixed at the first position in response to the indentation 88 being engaged with the latch stop 60. The protrusion 86 is moveable between a first position and a second position. At the first position the protrusion 86 is generally aligned with the right edge 37 and the indentation 86 is engaged with the latch stop 60. At the second position the protrusion 86 extends beyond the right edge 37 and the indentation is free from engagement with the latch stop 60. The latch stop 60 automatically moves from the first position to the second position, as explained above, thereby freeing the operator driver 48 and handle 64 for movement from the first position to the second position.

Referring to FIGS. 2–5, the protrusion 86 engages the door bracket 24 when the door 20 is closed and hinders opening of the door 20 at the second position of the protrusion 86. Conversely, at the first position, the protrusion 86 does not engage the door bracket 24.

Figure 9:
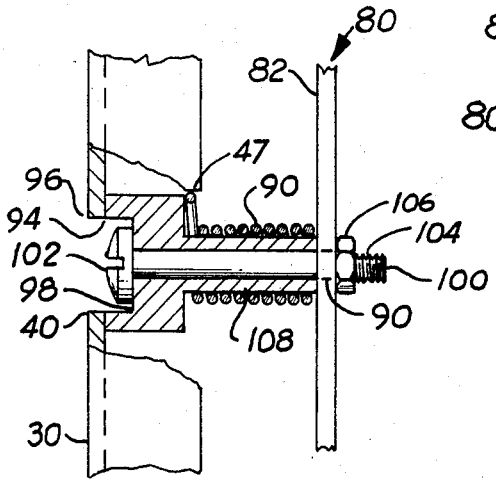
FIG. 9 is a side view similar to FIG. 7 but showing only the defeater screw.

Referring to FIG. 9, a spacer 94 which has a collar 96 and a shoulder 98 is positioned in the opening 40 so that the collar 96 overlays a portion of the surface of the frame middle portion 30 and the shoulder 98 is positioned between the opening 40 and the latch member 82. A fastener, such as a defeater screw 100 has a slotted head 102 abutting the shoulder 98 and a threaded shank 104 extending through the opening 90 of the latch member 82. The shank 104 is fitted with a nut 106 for retaining the latch member 82 on the shank 104. The shank 104 preferably has a noncircular cross-section which engages the latch member 82 in response to or in contact with the turning of the defeater screw 100.

The spacer 94 preferably has a stepped shank 108 which abuts the latch member 82 and the inner surface of the frame middle portion 30 and maintains a preselected distance therebetween. The stepped shank 108 is positioned about the shank 104 of the defeater screw 100 with the defeater screw 100 free to rotate about its longitudinal axis inside the stepped shank 108. The collar 96 can be welded to the middle portion 30 or the tension of the screw 100 may be sufficient force to insure cooperation of the collar 96 and shank 108 as a unit.

The spring 92 has one end seated in the right edge slot or opening 47 and the other end anchored to the latch member 82. The spring 92 is coiled about the stepped shank 108 and urges the latch member protrusion 86 towards the second position. The slotted head 102 of the defeater screw 100 is engageable with a screwdriver and rotatable in a counterclockwise direction. The latch member 82 rotates with the slotted head 102 and moves the protrusion 86 from the second position to the first position while the handle 64 remains at the second or "on" position.

In operation, the handle 64 is moved to the "off" position and is automatically held there by the engagement of the latch indentation 88 with the latch stop 60. The circuit breaker operator assembly 26 can now be mounted on the circuit breaker 18. When the handle 64 is in the "on" position the protrusion 52 prevents the assembly 26 from being mounted on the circuit breaker 18. Once mounted, the door 20 can be closed and the handle 64 can be moved from "off" to "on" whereby the protrusion 52 extends through the pan latch opening 16 to prevent removal of the assembly 26. If the door 20 is closed, it is locked closed by the protrusion 86 which moves into engagement with the door bracket 24 when the handle 64 is moved from "off" to "on".

Moving the handle 64 to the "off" position releases the door 20. The handle 64 can be padlocked in the "off" position to prevent unintentional operation of the circuit breaker 18. The door 20 is opened or closed with the handle 64 in the "on" position by rotating the defeater screw 100 approximately $\frac{1}{8}$ turn in the counterclockwise direction which moves the protrusion 86 out of engagement with the door bracket 24. This allows access to the insides of the motor controller 10 but does not allow the inadvertent or unintentional removal of the breaker 18 because the protrusion 86 fits through opening 16 and prevents operation of the pan latch 14. Thus, the handle 64 can be padlocked in either the "off" position which is common or the "on" position while preventing inadvertent or unintentional removal of the circuit breaker 18 under load.

Other aspects, objects and advantages of this invention can be obtained from a study of the drawings, the disclosure and the appended claims.

What is claimed is:

1. A circuit breaker operator, comprising:

a frame having a middle portion having an opening, a top portion having an opening and angularly extending from said middle portion in a preselected direction, a bottom portion angularly extending from said middle portion in a preselected direction, a mounting portion having an opening and being connected to said bottom portion, and a right edge portion;

an operator driver having an opening and a protrusion and being movable between a first position at which said opening is displaced toward said bottom portion of said frame and said protrusion extends through said opening in said top portion of said frame a first preselected distance above said top portion and a second position at which said opening is displaced from said bottom portion and said protrusion extends a second preselected distance above said top portion, said second preselected distance being greater than said first preselected distance;

an operator assembly having a base portion having a latch stop and being connected to said operator driver and a handle portion connected to the base portion and protruding through said opening of said middle portion of said frame, said base portion being larger than said opening of said middle portion, said handle being moveable in concert with said operator driver between a first position at which said handle is displaced toward said bottom portion and said operator driver is at the first position and a second position at which said handle is displaced toward said top portion and said operator driver is at the second position;

first means for urging said operator driver and said handle toward the second position;

a latch assembly having latch member having a left edge portion, a protrusion, and an indentation engageable with said latch stop of said base portion of said operator assembly and second means for urging said latch indentation into engagement with said latch stop, said handle and operator driver being fixed at the first position in response to said indentation being engaged with said latch stop, said protrusion being movable between a first position at which said protrusion is generally aligned with said right edge portion of said frame and said indentation is engaged with said latch stop and a second position at which said protrusion extends beyond said right edge portion and said indentation is free of engagement with said latch stop, said latch stop automatically moving into abutting contact with said left edge portion in response to movement of said protrusion from the first position to the second position thereby freeing said operator driver and handle for movement from the first position to the second position.

2. A circuit breaker operator, as set forth in claim 1, wherein said top portion of the frame and said bottom portion of the frame are substantially parallel.

3. A circuit breaker operator, as set forth in claim 1, wherein said bottom portion of the frame has an opening and said operator driver has a second protrusion extending through said bottom portion opening during movement of said operator driver between the first and second positions.

4. A circuit breaker operator, as set forth in claim 1, wherein said first means includes a spring coiled about said second protrusion of said operator driver and abutting said operator driver and said frame bottom portion.

5. A circuit breaker operator, as set forth in claim 1, wherein said first means includes a coil spring having a first end connected to the operator driver and a second end connected to said frame top portion.

6. A circuit breaker operator, as set forth in claim 1, wherein said frame middle portion has an opening, said frame right edge portion has an opening, said latch member has an opening, and said second means includes:

a fastener having a slotted head, a threaded shank extending through said latch member opening, and a nut threadably mateable with said shank and abutting said latch member; and a spring having a first end seated in said opening in said frame right edge portion and a second end anchored to said latch member and being coiled about said shank between said latch member and said frame middle portion, said slotted head being engageable with a screwdriver through said middle portion opening and rotatable in a counterclockwise direction.

7. A circuit breaker operator, as set forth in claim 6, wherein said latch rotates with said slotted head and moves said latch member protrusion from the second position to the first position while said handle remains at the second position.

8. A circuit breaker operator, as set forth in claim 7, including:

a spacer positioned about the threaded shank between the frame middle portion and the latch member.

9. A circuit breaker operator as set forth in claim 1, wherein said operator driver opening is of a size and configuration sufficient for receiving a circuit breaker handle therein and moving the circuit breaker handle from an "off" position to an "on" position in response to movement of said operator driver from the first position to the second position.

10. A circuit breaker operator, as set forth in claim 1, including:

a protrusion extending from said frame middle portion; and a padlock member having an opening therein of a size sufficient for receiving a shackle of a padlock and being positioned in said handle portion and slidably moveable between a first position at which the opening is concealed and the padlock member is free of interference with said protrusion during movement of said handle and a second position at which the opening is revealed and the padlock member iterferes with movement of said handle, said padlock member being free to receive said padlock when revealed.

11. A circuit breaker operator for a circuit breaker assembly of the type having a pan brace assembly removably mounted in an enclosure and having a slidable pan latch with an opening therein and a circuit breaker having a handle moveable between an "on" position and an "off" position and being mounted on the pan brace assembly; comprising:

a frame having a middle portion having an opening, a top portion having an opening and angularly extending from said middle portion in a preselected direction, and a bottom portion angularly extending from said middle portion in a preselected direction; and an operator driver having an opening for receiving said circuit breaker handle and a protrusion and being movable between a first position at which said opening is displaced toward said bottom portion of said frame and said protrusion extends through said opening in said top portion of said frame a first preselected distance above said top portion and said circuit breaker handle is at the "off" position and a second position at which said opening is displaced from said bottom portion and said protrusion extends a second preselected distance above said top portion and said circuit breaker handle is at the "on" position, said second preselected distance being greater than said first preselected distance, said protrusion being extendable through said pan latch opening at the second position and preventing inadvertent removal of said circuit breaker.

12. A circuit breaker operator, as set forth in claim 11, wherein said frame has a right edge portion and including:

an operator assembly having a base portion having a latch stop and being connected to said operator driver and a handle portion connected to the base portion and protruding through said opening of said middle portion of said frame, said base portion being larger than said opening of said middle portion, said handle being moveable in concert with said operator driver between a first portion at which said handle is displaced toward said bottom portion and said operator driver is at the first position and a second position at which said handle is displaced toward said top portion and said operator driver is at the second position;

first means for urging said operator driver and said handle toward the second position;

a latch assembly having latch member having a left edge portion, a protrusion, and an indentation engageable with said latch stop of said base portion of said operator assembly and second means for urging said latch indentation into engagement with said latch stop, said handle and operator driver being fixed at the first position in response to said indentation being engaged with said latch stop, said protrusion being movable between a first position at which said protrusion is generally aligned with said right edge portion of said frame and said indentation is engaged with said latch stop and a second position at which said protrusion extends beyond said right edge portion and said indentation is free of engagement with said latch stop, said latch stop automatically moving into abutting contact with said left edge portion in response to movement of said protrusion from the first position to the second position thereby freeing said operator driver and handle for movement from the first position to the second position.

13. A circuit breaker operator, as set forth in claim 12, wherein said bottom portion of the frame has an opening and said operator driver has a second protrusion extending through said bottom portion opening during movement of said operator driver between the first and second positions.

14. A circuit breaker operator, as set forth in claim 11, wherein said frame middle portion has an opening, said frame right edge portion has an opening, said latch member has an opening, and said second means includes:

a fastener having a slotted head, a threaded shank extending through said latch member opening, and a nut threadably mateable with said shank and abutting said latch member; and a spring having a first end seated in said opening in said frame right edge portion and a second end anchored to said latch member and being coiled about said shank between said latch member and said frame middle portion, said slotted head being engageable with a screwdriver through said middle portion opening and rotatable in a counterclockwise direction.

15. A circuit breaker operator, as set forth in claim 14, wherein said latch rotates with said slotted head and moves said latch member protrusion from the second position to the first position while said handle remains at the second position.

16. A circuit breaker operator, as set forth in claim 15, including:

a spacer positioned about the threaded shank between the frame middle portion and the latch member.

17. A circuit breaker operator, as set forth in claim 11, including:

a protrusion extending from said frame middle portion; and a padlock member having an opening therein of a size sufficient for receiving a shackle of a padlock and being positioned in said handle portion and slidably moveable between a first position at which the opening is concealed and the padlock member is free of interference with said protrusion during movement of said handle and a second position at which the opening is revealed and the padlock member interferes with movement of said handle, said padlock member being free to receive said padlock when revealed.

18. A circuit breaker operator for a circuit breaker assembly having a removable circuit breaker with a handle moveable between a first position and a second position, comprising:

a frame having a middle portion having an opening, a top portion having an opening and angularly extending from said middle portion in a preselected direction, and a right edge portion;

means for mounting said frame on said circuit breaker;

an operator driver having an opening, a first protrusion and a second protrusion extending through said bottom portion opening and being movable between a first position at which said opening is displaced toward said bottom portion of said frame and said first protrusion extends through said opening in said top portion of said frame a first preselected distance above said top portion and a second position at which said opening is displaced from said bottom portion and said protrusion extends a second preselected distance above said top portion, said second preselected distance being greater than said first preselected distance, said opening receiving said circuit breaker handle in the mounted position and moving in concert therewith between the first position and the second position, said first protrusion engaging said circuit breaker assembly at the second position in the mounted position of the circuit breaker and hindering removal of said circuit breaker;

an operator assembly having a base portion and being connected to said operator driver and a handle portion connected to the base portion and protruding through said opening of said middle portion of said frame, said base portion being larger than said opening of said middle portion, said operator handle being moveable in concert with said operator driver between a first position at which said operator handle is displaced toward said bottom portion and said operator driver is at the first position and a second position at which said handle is displaced toward said top portion and said operator driver is at the second position;

first means for urging said operator driver and handle toward the second position;

a latch assembly having latch member having a left edge portion, a protrusion, and an indentation engageable with said latch stop of said base portion of said operator assembly and second means for urging said latch indentation into engagement with said latch stop, said handle and operator driver being fixed at the first position in response to said indentation being engaged with said latch stop, said protrusion being moveable between a first position at which said protrusion is generally aligned with said right edge portion of said frame and said indentation is engaged with said latch stop and a second position at which said protrusion extends beyond said right edge portion and said indentation is free of engagement with said latch stop, said latch stop automatically moving into abutting contact with said left edge portion in response to movement of said protrusion from the first position to the second position thereby freeing said operator driver and handle for movement from the first position to the second position.

19. A circuit breaker operator, as set forth in claim 18, wherein said frame middle portion has a second opening, said frame right edge portion has an opening, said latch member has an opening and said second means includes:

a spacer having a collar and a shoulder and being positioned in said second opening with said collar overlaying a portion of the surface of the frame middle portion and the shoulder being positioned between said second opening and said latch member;

a fastener having a slotted head abutting said shoulder and a shank extending through said latch member opening, said latch member turning in response to turning of the fastener;

third means for retaining said latch member on said shank; and a spring having a first end seated in said opening in said right edge portion and a second end anchored to said latch member and being coiled about said spacer between said latch member and said frame middle portion, said slotted head being engageable with a screwdriver through said second middle portion opening a rotatable in a counterclockwise direction.

20. A circuit breaker operator, as set forth in claim 19, wherein said latch member rotates with said slotted head and moves said latch member protrusion from the second position to the first position while said operator handle remains at the second position.

* * * * *